US006240702B1

(12) United States Patent
Wilson

(10) Patent No.: US 6,240,702 B1
(45) Date of Patent: Jun. 5, 2001

(54) FACIA BOARD RACK

(75) Inventor: Ricky Wilson, Hayward, CA (US)

(73) Assignee: Ricky A. Wilson, Fresno, CA (US)

( * ) Notice: Subject to any disclaimer, the term of this patent is extended or adjusted under 35 U.S.C. 154(b) by 0 days.

(21) Appl. No.: 09/259,466

(22) Filed: Feb. 26, 1999

(51) Int. Cl.[7] ..... E04D 15/00

(52) U.S. Cl. ..... 52/749.1; 52/702; 52/712; 52/698; 52/90.1

(58) Field of Search ..... 52/90.1, 92.3, 52/93.2, 91.1, 92.1, 698, 699, 702, 704, 712

(56) References Cited

U.S. PATENT DOCUMENTS

| | | | | |
|---|---|---|---|---|
| 652,292 | * | 6/1900 | Schild et al. | 52/712 |
| 733,187 | * | 7/1903 | Grant | 52/712 |
| 816,297 | * | 3/1906 | Charls | 52/712 |
| 1,280,173 | * | 10/1918 | Cutler | 52/712 |
| 2,300,113 | * | 10/1942 | Faber | 52/714 |
| 4,340,100 | * | 7/1982 | Anderson, II | 52/127 |
| 4,551,956 | * | 11/1985 | Axford | 52/12 |
| 4,646,496 | * | 3/1987 | Wilnau | 52/712 |
| 4,709,527 | * | 12/1987 | Cooley | 52/712 |
| 4,715,161 | * | 12/1987 | Carraro et al. | 52/714 |
| 4,836,517 | | 6/1989 | Vossler . | |
| 4,947,616 | | 8/1990 | Sorton . | |
| 5,088,682 | | 2/1992 | Gibbs . | |
| 5,181,683 | * | 1/1993 | Smith | 248/227 |
| 5,192,059 | | 3/1993 | Silver . | |
| 5,228,667 | | 7/1993 | Bridegum . | |
| 5,383,320 | | 1/1995 | Sorton . | |
| 5,388,813 | | 2/1995 | Arsenault . | |
| 5,611,189 | * | 3/1997 | Fleck | 52/93.2 |
| 5,617,694 | * | 4/1997 | Baba | 52/712 |
| 5,806,265 | * | 9/1998 | Sluiter | 52/643 |
| 6,076,325 | * | 6/2000 | Sluiter | 52/712 |

* cited by examiner

*Primary Examiner*—Carl D. Friedman
*Assistant Examiner*—Dennis L. Dorsey
(74) *Attorney, Agent, or Firm*—Michael A. Glenn

(57) ABSTRACT

The invention provides an easy to use and inexpensive to manufacture facia board rack for temporarily holding a facia board in position for attachment to a building. The rack is a single member formed in such a way that it may be mounted to the side of a building to provide a ledge which projects therefrom upon which a facia board may be supported during the installation of the facia board. An optional riser member may be used with the rack to adjust the depth of a channel in the rack. The holder may be used either before or after the roof deck of the building is installed.

12 Claims, 4 Drawing Sheets

FACIA BOARD RACK

BACKGROUND OF THE INVENTION

1. Technical Field

The invention relates to devices used in the field of carpentry. More particularly, the invention relates to an improved device for holding a facia board in position while the facia board is attached to a building.

2. Description of the Prior Art

When constructing a building, facia boards are often attached to the roof of the building. The boards typically are very long and generally unwieldy and are difficult for one person to properly position, hold and attach and it is desirable to provide for a tool which will hold these long boards in position for attachment to the building by a single person without assistance. Various devices have been used for holding facia boards or other types of beams during construction, but none of these teach the use of a single member, such as a single plate, that may be attached to the side of a building and provide a ledge to support a facia board and which may be used prior to the roof deck is installed.

U.S. Pat. No. 5,192,059 (Fascia Board Holder) discloses the use of an adjustable holder having a number of members. The holder comprises a first channel section adapted to receive a roof rafter, a fastening means to secure the channel section to a rafter, a planar element pivotally mounted on the channel section, a means to releasably secure the planar-element to the channel section, and a second channel section rigidly mounted on the planar element adapted to hold a facia board. Generally a clamping screw is used to secure the first channel section to the rafter and a clamping nut is used to secure the planar-element to the second channel section. This holder is complicated to use because of the number of parts involved. Furthermore, some of its parts, especially the clamping nut and screw could be easily lost at a construction site, making the holder inoperative. Because the holder has a channel which fits over a rafter, it may be used only prior to the installation of the roof deck on the rafters. Hence a builder needs to delay the construction of the roof deck until the facia boards are installed.

U.S. Pat. No. 5,088,682 (Facia Installation Holder) also discloses the use of an adjustable holder having several members. This holder comprises a generally L-shaped mounting bracket having one leg portion adapted for removable attachment to an external surface of a building's roof deck at its edge with a second leg depending down adjacent the position at which the facia board is to be attached. A support member extends from the depending second leg beneath the installation position and supports the facia board in position. A fastening means such as a thumb screw is used to hold the support member at designated positions along the depending second leg. The position of the support member corresponds with different facia board widths. This holder needs to be adjusted for different facia board widths. Furthermore, some of its parts, especially the thumb screw could be easily lost at a construction site, making the holder inoperative. Also, because this device attaches to a roof deck, it requires that the roof deck be constructed prior to installation of the facia boards. Hence a builder needs to delay the installation of the facia boards until the roof deck is completed. It would be advantageous to have an inherently simple facia board holder with no moveable parts, which is easy to use and inexpensive to manufacture, and which may be used either prior to or after the roof deck is constructed.

SUMMARY OF THE INVENTION

The invention provides an easy to use and inexpensive to manufacture facia board rack for temporarily holding a facia board in position for attachment to a building. The rack is a single member formed in such a way that it may be mounted to the side of a building rafter tail to provide a ledge which projects therefrom upon which a facia board may be supported during the installation of the facia board. An optional riser member may be used with the rack to adjust the depth of a channel in the rack The holder may be used either before or after the roof deck of the building is installed.

DETAILED DESCRIPTION OF THE INVENTION

The invention provides an easy to use and inexpensive to manufacture facia board rack for temporarily holding a facia board in position for attachment to a building. The rack is a single member formed in such a way that it may be mounted to the side of a building to provide a ledge which projects therefrom upon which a facia board may be supported during the installation of the facia board. An optional riser member may be used with the rack to adjust the depth of a channel in the rack The rack may be used either before or after the roof deck of the building is installed. This invention may be called a holder as well as a rack.

Figure 1:
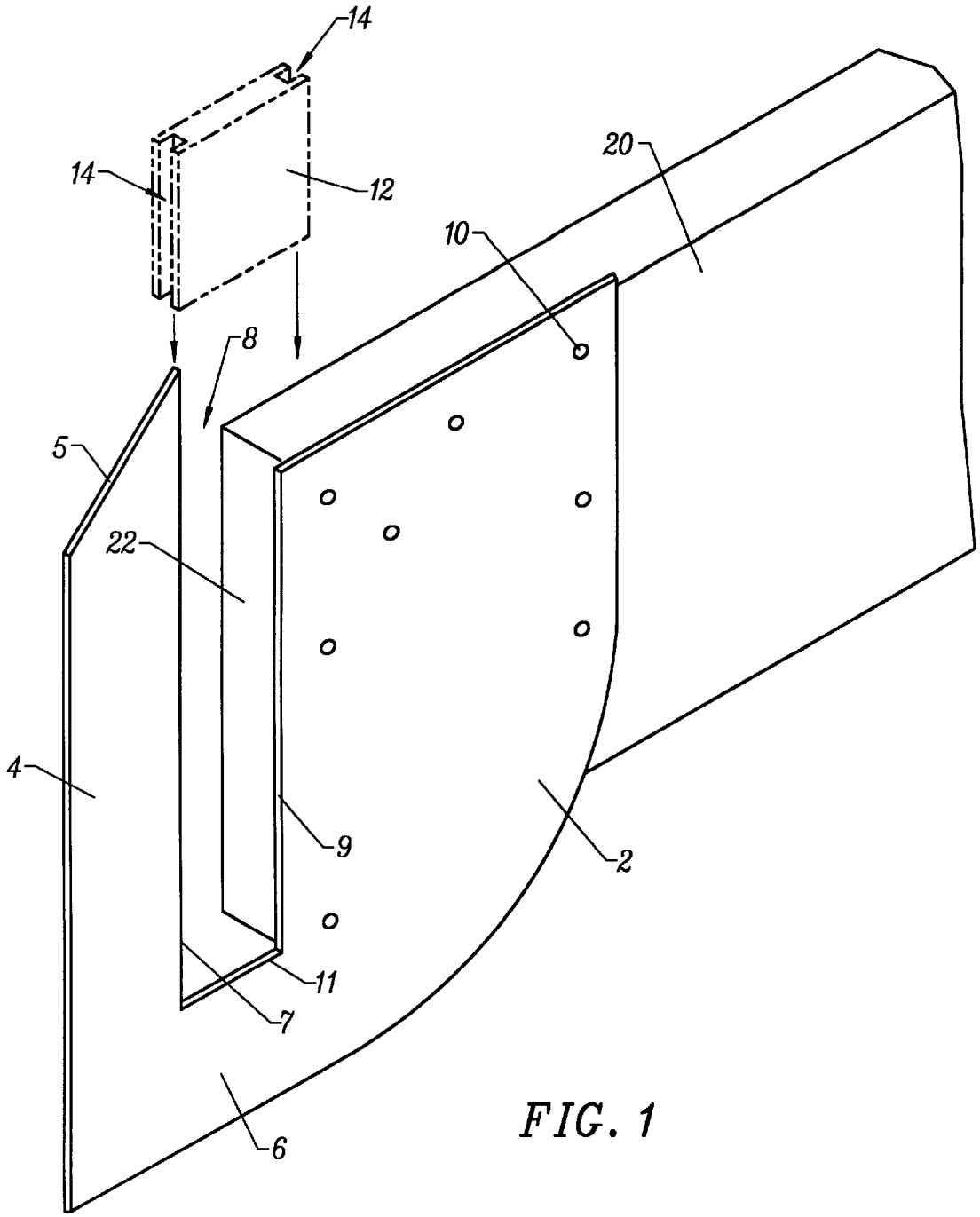
FIG. 1 is a perspective view of a facia rack.

As seen in FIG. 1, the invention comprises a planar member having a main section 2, a vertical section 4, and a connecting section 6. The main, connecting, and vertical sections define a channel 8 for receiving a facia board. The main section has a plurality of apertures 10 formed therein for accepting fasteners, wherein the main section can be temporally secured to a rafter 20 of a roof. The fasteners will generally be nails or screws for a wooden rafter and screws for a metal rafter. Screws are generally preferred because they go in and come out of the rafter easily, e.g. when using metal rafters. When using nails, it is advantageous to use double-headed nails, so that the nails can be easily removed without damaging the member. If regular nails are used, they should not be driven completely home but a portion should be left extending so that the nails can be easily removed without damaging the member. It will be appreciated that other types of fasteners such as tacks and bolts may be used. The various apertures 10 are positioned across the member so that different sized rafters can be accommodated. For example, apertures are located in the middle of the member to accommodate narrower boards. In general, more fasteners, hence more apertures, are required for larger or longer facia boards than for smaller or shorter facia board to counter the increased weight. It will be appreciated that different numbers and configurations of apertures may well equally be used in addition to those shown herein. It is preferred that the height of the vertical section 4 be greater than the height of the main section 2 to help prevent the facia board from falling off the roof while the craftsmen is positioning the facia board in the channel 8. It is further preferred that the top edge of the vertical section 5 be tapered or cut on a radius to facilitate positioning the facia board in the channel 8.

Figure 2:
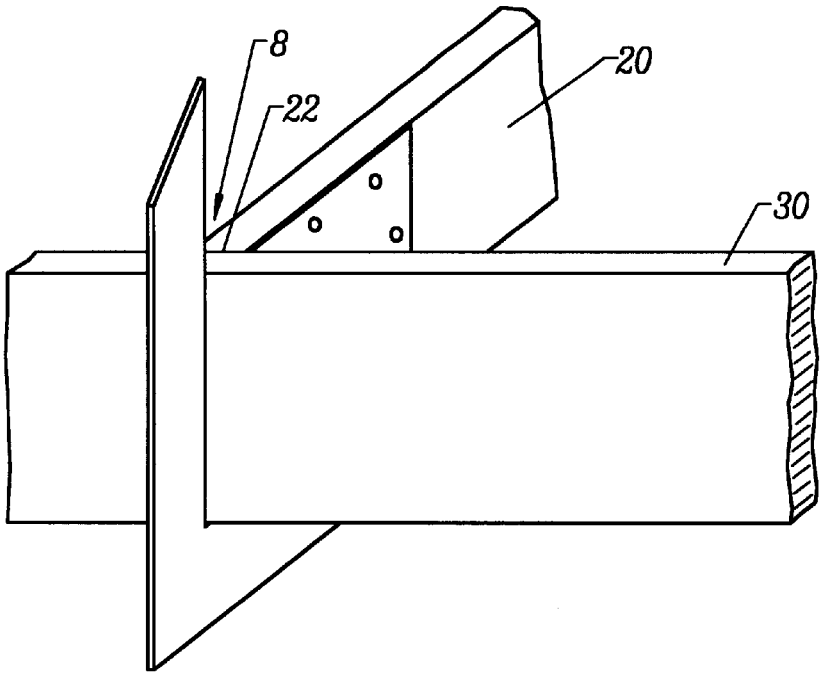
FIG. 2 is a perspective view of the rack of FIG. 1 with a facia board in operative position.

When the holder is mounted in operative position on a rafter, the channel 8 is oriented so as to receive a facia board 30 therein and support it in abutting planar relationship with the end of the rafter 22, as shown in FIG. 2. The facia board can then be secured to the ends 22 of each rafter 20 along the length thereof, usually by means of nails or screws. As shown in FIG. 1, the vertical edges 7 and 9 of the channel 8 are designed to be fixed and perpendicular to the bottom edge 11 of the channel 8. This design ensures that the facia board is held flush to the rafter end 22.

Generally the rack is made from a ⅛-inch thick plate of aluminum alloy sheet metal, however it will be appreciated that other materials such as plastics or steel may equally well be employed. The dimensions of the sections are adapted to the size of the rafter and the facia boards. For example, a rack designed to be used with 2"×4", 2"×6", 2"×8" and 2"×10" facia boards will generally have the following dimensions: the height and width of main section will be approximately 11 inches and 6_inches, respectively, the height and the width of the vertical section will be approximately 13 inches and 2 inches, respectively, and the width of the channel will generally be approximately 2 inches. Other sizes may, of course be fabricated. The lower outer section of the main section may be rounded as shown in FIG. 1 or square.

Figure 3:
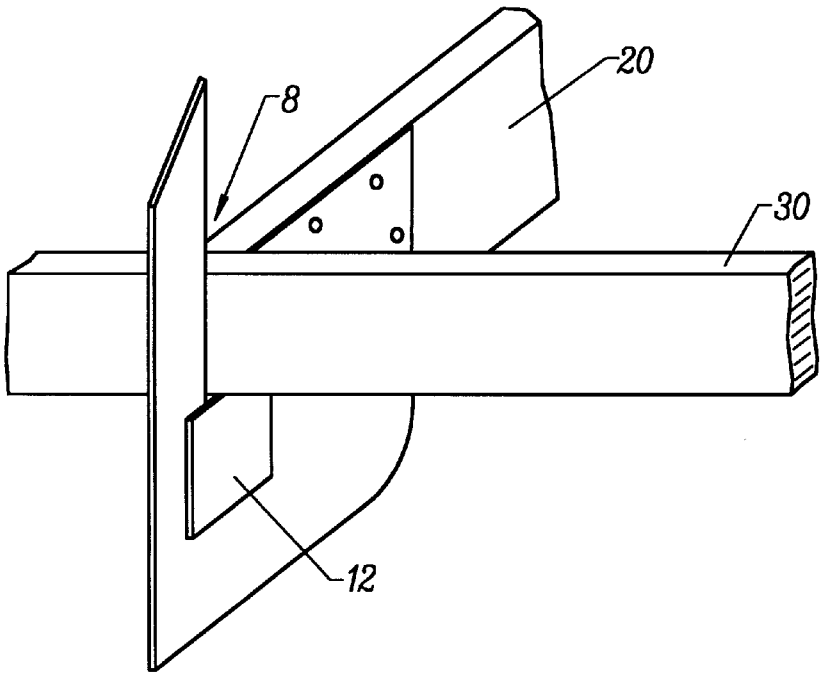
FIG. 3 is a perspective view of the rack of FIG. 1 and a riser with a facia board in operative position.

In some situations, it is advantageous to use a riser 12 with the rack, as shown in FIG. 3, to adjust the depth of the channel 8 to accommodate different sizes of facia boards. The closer the facia board 30 is to the top of the channel 8 of the rack, the more accurately it can be fastened to the rafters. As shown in FIG. 1, the riser has channels 14 therein and is slideably inserted into the channel 8 of the rack When used with a channel approximately 2 inches wide the riser is typically ⅜ inches thick, 2 inches wide, and 2 inches or 4 inches high.

Figure 4:
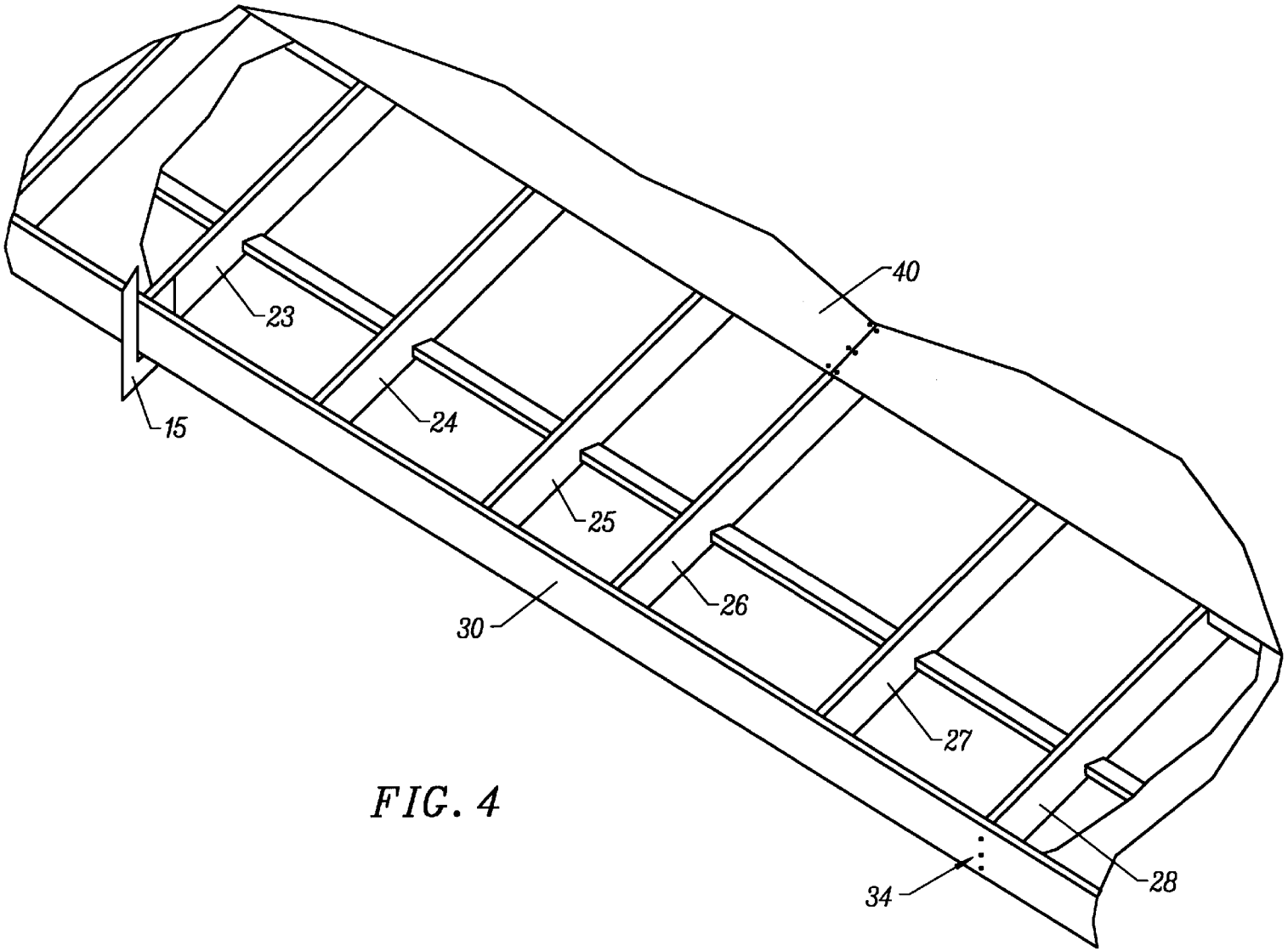
FIG. 4 is a perspective view of the rack of FIG. 1 being used by a craftsman.

Shown in FIG. 4 is a rack 15 according to the invention in use holding one portion of facia board 30 in position while a craftsman 34 is attaching another section the facia board to the external surface of the roof. In one situation, the craftsman would attach the rack to a rafter 23 of the building, place one section of a facia board in the channel section of the rack position another section of the facia board in abutting planar relationship with the end of another rafter 28, attach the facia board to the second rafter 28, attach the facia board to the rafter 23 which had held the rack remove the rack from said rafter 23 and attach the facia board to the other rafters 24, 25, 26, 27 along which the facia board extends. It will be appreciated that while this invention has made reference to a specific order of steps for installing a facia board, once the facia board is attached to one rafter, the order in which the rack is removed and the facia board is attached to the other rafters found along its length may equally well be varied. Then the craftsman repeats the process with the other facia boards to be installed.

Figure 5:
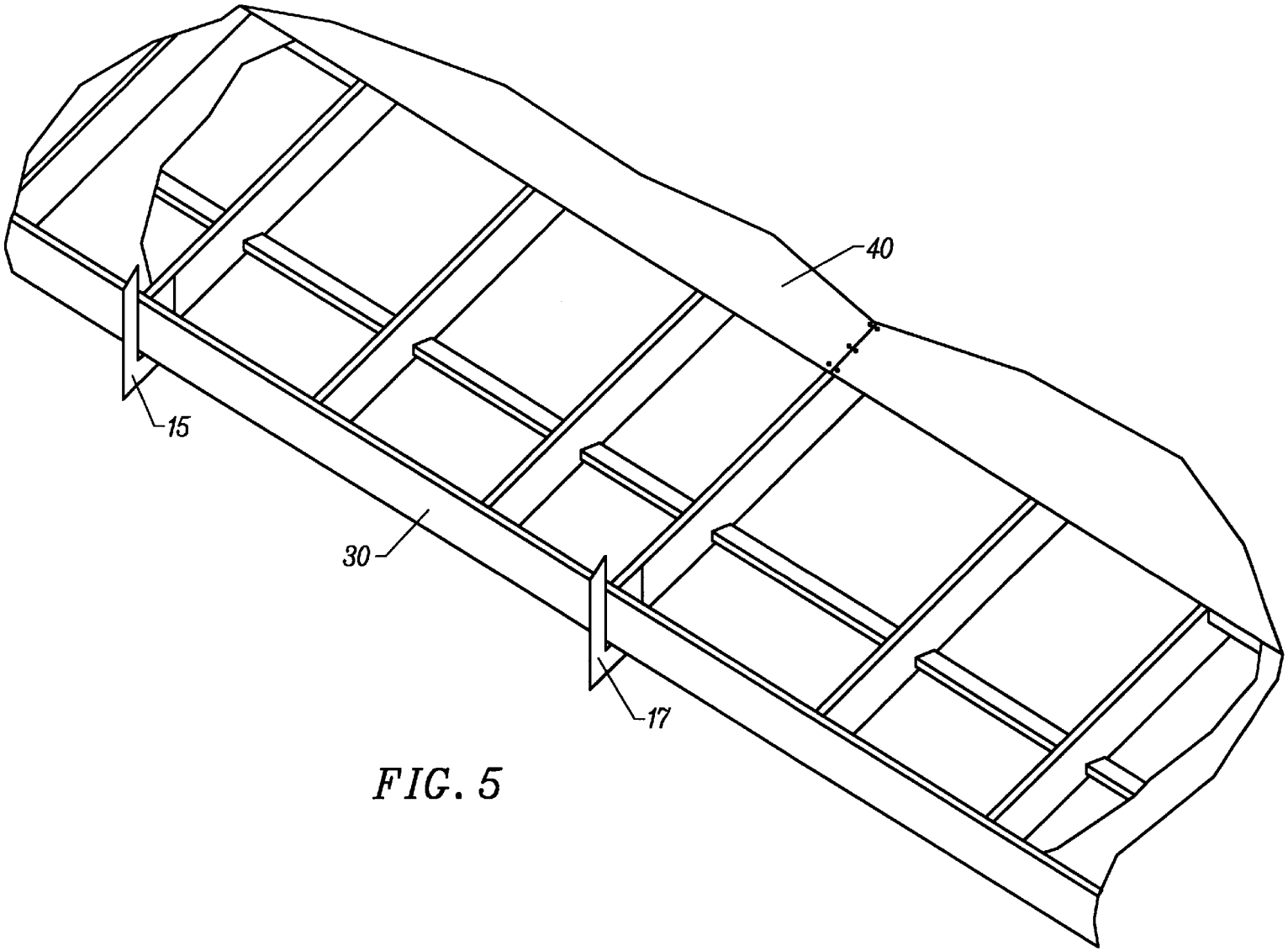
FIG. 5 is a perspective view of a pair of facia racks in operative position.

It is contemplated that more than one rack could be used to facilitate the installation of facia boards. Shown in FIG. 5 are a pair of racks 15 and 17 in use holding a facia board 30 so as to support the board in a vertical plane and substantially parallel to the ground. As seen in FIG. 5, the facia boards may be installed using the rack either prior to or after the roof deck 40 is installed. This gives a builder flexibility in determining the sequence for installing the facia boards and the roof deck. For example, a carpenter would not need to wait for a forklift to position the sheeting material to form the roof deck and the installation of the deck before he could install the facia boards.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

What is claimed is:

1. A device for holding a facia board in a position for attachment to a building, comprising:

a unitary member having a planar surface adapted to attach adjacent one end of a roof rafter of the building and having a plurality of apertures formed therein for accepting fasteners, wherein said member can be secured to said rafter in a desired configuration;

a channel section formed in the unitary member, adapted to receive and retain therein said facia board; and a riser member adapted to insert into said channel section.

2. The device of claim 1 wherein said fasteners are selected from the group consisting of nails, screws, tacks, and bolts.

3. The device of claim 1 fabricated from a material selected from the group consisting of aluminum alloy sheet material, steel, and plastic.

4. A facia board holder for removable attachment adjacent one end of a roof rafter, said holder comprising:

a main section;

a vertical section;

a connecting section between said main section and said vertical section, said main, connecting, and vertical sections defining a channel section for receiving a facia board; wherein the height of the vertical section is greater than the height of the main section and a plurality of apertures formed through said main section for accepting fasteners, wherein the facia board holder can be secured in a desired configuration.

5. The facia board holder in claim 4 wherein said fasteners are selected from the group consisting of nails, screws, tacks, and bolts.

6. The facia board holder in claim 4 fabricated from a material selected from the group consisting of aluminum alloy sheet material, steel, and plastic.

7. A facia board holder for removable attachment adjacent one end of a roof rafter, said holder comprising:

a main section;

a vertical section;

a connecting section between said main section and said vertical section, said main, connecting, and vertical sections defining a channel section for receiving a facia board;

a plurality of apertures formed through said main section for accepting fasteners, wherein the facia board holder can be secured in a desired configuration; and a riser member adapted to slideably insert into said channel section.

8. The facia board holder in claim 7 wherein said fasteners are selected from the group consisting of nails, screws, tacks, and bolts.

9. The facia board holder in claim 7 fabricated from a material selected from the group consisting of aluminum alloy sheet material, steel, and plastic.

10. The facia board holder in claim 7 wherein the height of the vertical section is greater than the height of the main section.

11. A process for attaching a facia board to a roof of a building having a plurality of rafters, comprising the steps of:

attaching a single member planar facia board holder having a slot with a rear vertical edge to one end of a first roof rafter so as to align said rear vertical edge of said slot with the vertical edge of the end of the roof rafter;

placing a portion of the facia board into the facia board holder in perpendicular abutting relation to said first rafter;

positioning the facia board against the edge of a second roof rafter in perpendicular abutting relation to said second rafter;

securing the facia board to the edge of the second roof rafter;

securing the facia board to the edge of the first roof rafter;

unattaching the facia board holder from the first roof rafter; and securing the facia board to the edges of the other roof rafters positioned along the length of said facia board.

12. A process for attaching a facia board to a roof of a building having a plurality of rafters, comprising the steps of:

attaching a number of a single member planar facia board holders each having a slot having a rear vertical edge to one end of a number of roof rafters so that said rear vertical edges are aligned with the vertical edges of the ends of said roof rafters;

placing the facia board into the facia board holders in perpendicular abutting relation to said rafters, wherein the facia board is supported in a vertical plane and is substantially parallel to the ground;

securing the facia board to the edges of the roof rafters positioned along the length of said facia board; and unattaching the facia board holders.

* * * * *